United States Patent [19]

Gould et al.

[11] 4,356,459

[45] Oct. 26, 1982

[54] FLAT PHASE RESPONSE SEPTUM POLARIZER

[75] Inventors: Harry J. Gould, Mesa, Ariz.; Keiji Kawaguchi, Mountain View, Calif.

[73] Assignee: Ford Aerospace & Communications Corp., Detroit, Mich.

[21] Appl. No.: 246,461

[22] Filed: Mar. 23, 1981

[51] Int. Cl.[3] ..... H01P 1/16

[52] U.S. Cl. ..... 333/21 A; 333/248

[58] Field of Search ..... 333/21 A, 157, 251, 333/248

[56] References Cited

U.S. PATENT DOCUMENTS

| | | | |
|---|---|---|---|
| 2,599,753 | 6/1952 | Fox | 333/21 A |
| 3,096,474 | 7/1963 | Marie . | |
| 3,142,061 | 7/1964 | Allen . | |
| 3,428,922 | 2/1969 | Matthaei . | |
| 3,500,460 | 3/1970 | Jones et al. . | |
| 3,516,032 | 6/1970 | Wernli . | |
| 3,955,202 | 5/1976 | Young . | |
| 3,958,192 | 5/1976 | Rootsey . | |
| 3,958,193 | 5/1976 | Rootsey . | |
| 3,969,691 | 7/1976 | Saul . | |
| 4,100,514 | 7/1978 | DiTullio et al. | 333/21 A X |
| 4,126,835 | 11/1978 | Gould . | |

*Primary Examiner*—Paul L. Gensler

*Attorney, Agent, or Firm*—Edward J. Radlo; Robert D. Sanborn

[57] ABSTRACT

A septum polarizer offering an exceptionally low axial ratio over a wide frequency band. A first trapped mode resonator or resonator pair is inserted in the circularly polarizing waveguide within the same plane as the septum and tuning screws to create a desired resonant response at a frequency lower than the cutoff frequency of the polarizer. Optionally, a second pair of trapped mode resonators is inserted in two opposing waveguide walls that are orthogonal to the septum, to create a desired resonant response at a higher frequency than the upper frequency limit of the polarizer. The resonators serve to flatten the phase response of the polarizer throughout its passband, thereby maximizing the purity of circularly polarized radiation produced thereby.

8 Claims, 6 Drawing Figures

MEASURED AXIAL RATIO RESPONSE

FLAT PHASE RESPONSE SEPTUM POLARIZER

BACKGROUND OF THE INVENTION

1. Field of the Invention

This invention pertains to improvements in the axial ratio of circularly polarized microwave signals formed by a septum polarizer, whether just one direction of circular polarization is used or both left hand circular polarization (LHCP) and right hand circular polarization (RHCP) are employed.

A septum polarizer performs the dual functions of transforming a linearly polarized signal into a circularly polarized signal and acting as an Orthomode transducer. This dual capability makes the septum polarizer a logical choice for use as a dual polarization frequency reuse feed element in a microwave communications system, e.g., a satellite communications system.

The septum converts a linearly polarized signal into a circularly polarized signal by providing a 90° differential phase shift between two propagating orthogonal linearly polarized electromagnetic fields, designated as $E_X$ and $E_Y$ for their electric vector components.

The axial ratio is a measure of the circularity of the signal. It is desired for the circularly polarized signal to have an axial ratio as low as possible, preferably 0 dB. In order to do this, the polarizer must yield a phase shift between $E_X$ and $E_Y$ as close as possible to 90°. The present invention accomplishes this over a very broad frequency range.

2. Description of the Prior Art

U.S. Pat. Nos. 4,126,835 and 3,500,460 are illustrative of septum polarizers.

U.S. Pat. Nos. 3,428,922 and 3,516,032 disclose mode filters but do not utilize trapped mode resonators in a septum polarizer as in the present invention.

Of general interest are U.S. Pat. Nos. 3,955,202, 3,969,691, 3,958,192, 3,958,193, 3,096,474 and 3,142,061.

SUMMARY OF THE INVENTION

The present invention utilizes at least one trapped mode resonator at a strategic point within a septum polarizer waveguide. The purpose of the resonator(s) is to lower the axial ratio of circularly polarized signals produced by the polarizer over a broader bandwidth than is obtainable using prior art polarizers. At least a first trapped mode resonator is inserted in the waveguide wall, normally within the same plane as the septum and any tuning screws. This primary trapped mode resonator consists of an elongated thin conductive probe portion which lies along the longitudinal axis of the waveguide, and a conductive positioning portion which is orthogonal to the probe portion and connects the probe portion to the waveguide wall. This primary trapped mode resonator creates a desired resonant response at a frequency lower than the lower frequency limit (i.e., the "cutoff frequency") of the polarizer. The amplitude and frequency of the response is governed by proper dimensioning of the elements of the resonator as described herein.

If the first primary trapped mode resonator is situated in the nonseptum portion of the waveguide, a second primary trapped mode resonator having the same dimensions as the first is placed on the opposite wall of the waveguide. Additional secondary trapped mode resonators are situated on adjacent walls of the waveguide to the first resonator(s) at the same point along the longitudinal axis of the waveguide, and serve to create a second desired resonant response at a higher frequency than the upper frequency limit of the polarizer. In some applications (where the phase response of the polarizer sans resonators is skewed to lower frequencies than desired), just the pair of secondary resonators, and no primary resonators, is used.

By adjusting the dimensions of the resonators, the phase response throughout the desired bandwidth can be made very close to 90°, substantially better than prior art septum polarizers. The present invention thus has applicability in lowering the axial ratio of circularly polarized energy produced by a septum polarizer, whether just a single type of circular polarization is used, or both LHCP and RHCP are used.

BRIEF DESCRIPTION OF THE DRAWINGS

These and other more detailed and specific objects and features of the present invention are more fully disclosed in the following specification, reference being had to the accompanying drawings, in which.

DESCRIPTION OF THE PREFERRED EMBODIMENTS

Figure 1:
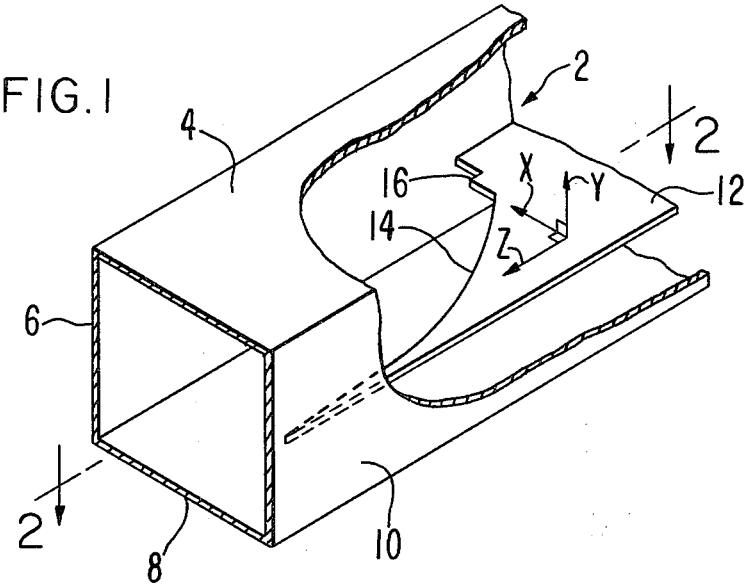
FIG. 1 is a partially broken-away perspective view of a septum polarizer which can be modified by the present invention wherein the polarizer is lying on its side so that wall 6 is the top wall and wall 10 is the bottom wall.

FIG. 1 is an illustration of a septum polarizer of the prior art (that disclosed in U.S. Pat. No. 4,126,835) which can be modified by means of the present invention to obtain the superior results described herein. It must be remembered that this particular septum polarizer is merely exemplary of those polarizers which may be modified by the present invention. Any septum polarizer, whether utilizing square waveguide as in FIG. 1, or circular waveguide, can be so improved by utilizing the teachings of the present invention.

The FIG. 1 polarizer comprises an elongate piece of hollow electrically conductive waveguide 2 having a square cross-section. The four walls of the waveguide are designated 4, 6, 8, and 10, as shown. If circular waveguide were employed rather than square waveguide, these four walls would be identical quarter-arc sections of a right-circular hollow conductive cylinder. The direction of propagation in FIG. 1, if one is converting a linearly polarized microwave signal to circular polarization, is from right to left. A thin elongated electrically conductive septum 12 extends along the longitudinal axis of the polarizer between walls 6 and 10 and forms a plane that is situated half way between walls 4 and 8. This particular septum 12 has a sloping portion 14 and a knee 16.

Three orthogonal axes are defined as shown in FIG. 1. The Z axis is the longitudinal axis of waveguide 2 and represents the direction of propagation of the microwave energy. The X axis lies in the plane of septum 12, and the Y axis is orthogonal to each of the X and Z axes.

Figure 2:
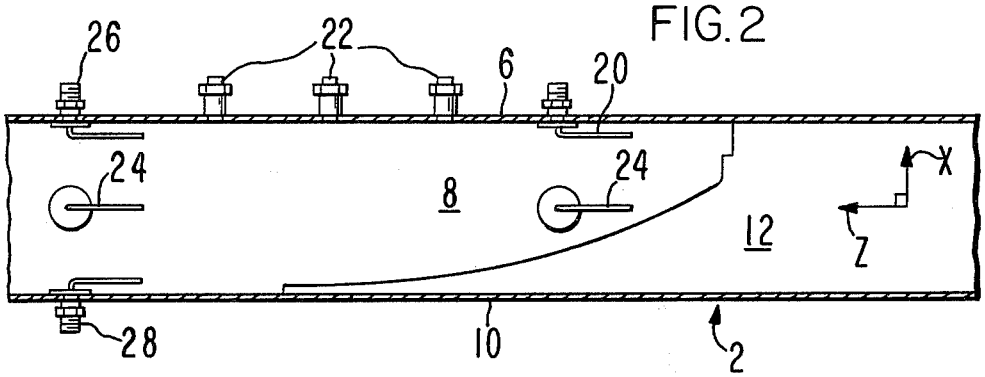
FIG. 2 is a cross-sectional side view of the septum polarizer of FIG. 1 with the addition of trapped mode resonators of the present invention.
Figure 5:
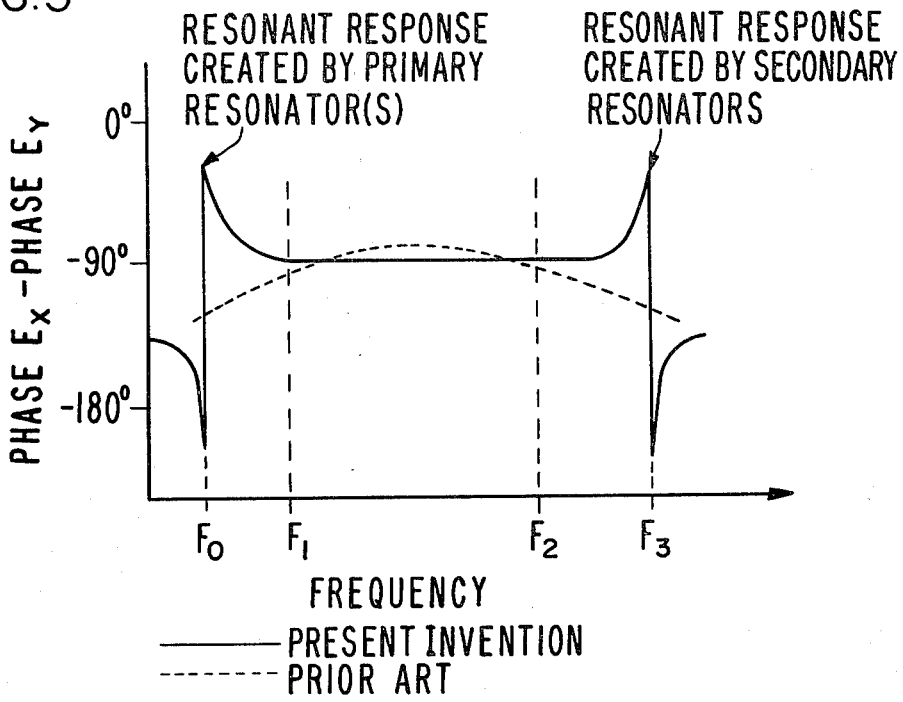
FIG. 5 is a graph of the phase response of a septum polarizer utilizing the present invention, compared with that of the prior art.

FIG. 2 is a cross-sectional side view of waveguide 2 wherein the front half of the waveguide has been broken away. Waveguide 2 can be considered as having two portions: a septum portion defined as that region where a cross-section of the waveguide cuts septum 12, and a nonseptum portion where a cross-section of the waveguide does not cut through septum 12. Along upper wall 6 of the waveguide are three tuning screws 22 which are in the same plane as septum 12. Tuning screws 22 are conventional; they serve to put a bend in the phase response of the polarizer. This is illustrated in FIG. 5 by the dotted line, representing the balanced phase septum polarizer of U.S. Pat. No. 4,126,835. The phase response of a septum polarizer waveguide is a curve illustrating the phase of $E_X$ minus the phase of $E_Y$ in the nonseptum portion of the waveguide as a function of frequency. Tuning screws 22 serve to put a bend in the phase response, so that it is not monotonically increasing or decreasing across the frequency domain.

Figure 4:
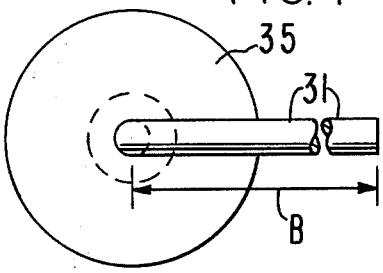
FIG. 4 is a bottom view of the trapped mode resonator of FIG. 3 viewed along lines 4—4 of FIG. 3.

Protruding from top wall 6 and lying in the same plane as tuning screws 22 and septum 12 is primary trapped mode resonator 20. The placement of resonator 20 within this plane is unimportant, e.g., it can be positioned in the septum portion of the waveguide as illustrated or in the nonseptum portion, where it is depicted in its alternative embodiment as item 26. If positioned in the nonseptum portion, it is necessary to employ identical primary resonator 28, protruding from lower wall 10 at the same point along the Z axis of waveguide 2 as resonator 26, and positioned opposite resonator 26 so that the probe portions 31 (see FIG. 4) of each primary resonator 26 and 28 lie in the plane of septum 12. The dimensions of primary resonator 20 (or primary resonator pair 26, 28) are selected so that a resonate response is created in the polarizer at a frequency somewhat lower than the lowest operational frequency of the polarizer, as illustrated in FIG. 5. Each primary resonator is positioned so that its probe portion 31 is aligned along the Z axis. It matters not whether the probe portion 31 points with or against the direction of propagating radiation.

Optionally, a pair of secondary trapped mode resonators 24, 30 may be employed protruding from walls 8 and 4, respectively, of waveguide 2. The secondary resonators are either in addition to or in lieu of the primary resonator(s) as described below. If both primary resonator(s) and secondary resonators are used, the secondary resonators are placed at the same point along the Z axis of the waveguide as primary resonator 20 or primary resonator pair 26, 28 (resonator 30 is not illustrated because wall 4 is not illustrated in FIG. 2). Secondary resonators 24, 30 are each situated halfway between walls 6 and 10 with probe portion 31 pointing along the Z axis, either opposite to or in the same direction as the direction of radiation.

Resonators are always employed in pairs (except for when a simple primary resonator is used within the septum portion of the polarizer) to preserve the symmetry of the effects produced by the resonators on the two directions of circular polarization (LHCP and RHCP).

Figure 3:
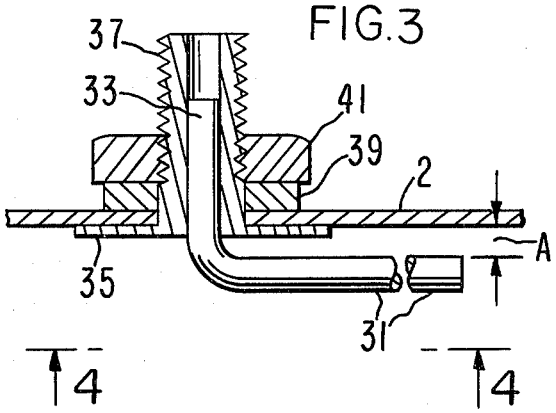
FIG. 3 is a partially broken-away side view of a trapped mode resonator of the present invention.

FIG. 3 illustrates the detailed design of each of the trapped mode resonators. A thin cylindrical piece of conductor such as a wire forms probe portion 31 and positioning portion 33. Portions 31 and 33 are roughly orthogonal to each other. Dimension A is the distance from the nearest wall of waveguide 2 to probe portion 31 of the resonator. The length of probe portion 31 is measured from the end of the probe to the midpoint of positioning portion 33, as illustrated by dimension B on FIG. 4. For operation around 4 GHz (as in FIG. 6), it has been found that a suitable diameter for each resonator is 0.037 inch, a suitable value of dimension B for each primary resonator is 0.84 inch, and a suitable value of dimension A for each primary resonator is 0.020 inch. For operation around 6 GHz, a suitable diameter for each resonator is 0.037 inch, a suitable value of dimension B for each primary resonator is 0.68 inch, and a suitable value of dimension A for each primary resonator is 0.010 inch. The above dimensions are only examples; others also work. For all passbands, the B dimension for the secondary resonators is less than the B dimension for the primary resonator(s).

Support disk 35 is a conductor, e.g., a metal washer, and aids in the accurate positioning of probe portion 31. Disk 35 should be made as thin as mechanically possible so as to minimize its impact upon the electrical characteristics of the system. The top of positioning portion 33 is rigidly affixed to the inside of screw 37 as by soldering. The resonator is mechanically affixed to waveguide 2 by means of washer 39 and nut 41.

The length of probe portion 31 governs the frequency of operation of the resonator and dimension A governs the degree of coupling. This is best illustrated by examining FIG. 5, which shows the phase response of the balanced phase septum polarizer of U.S. Pat. No. 4,126,835 as a dotted line, and the phase response of a septum polarizer utilizing the present invention as a solid line. Primary resonator 20 (or primary resonator pair 26, 28) creates the lower frequency spike, which is a resonant respone at frequency $F_0$. The frequency of this spike is determined by the length of probe portion 31 of each primary resonator. $F_0$ is selected to be less than $F_1$, the lowest (cutoff) frequency of the desired passband. The vertical range of the spike is governed by dimension A of each primary resonator; increasing A increases the vertical range.

Lengthening probe 31 lowers the frequency $F_0$ of the resonant response and shortening the length of 31 increases this frequency. If the frequency $F_0$ is selected to be too close to $F_1$, the phase response will not be flat within the lower frequency portion of the passband because the downward-sloping (with respect to increasing frequency) portion of the solid curve just to the right of $F_0$ will be within the passband. On the other hand, if $F_0$ were chosen to be too far away from $F_1$, the primary resonator(s) would have less of an impact on the operation of the polarizer, which would be evidenced in FIG. 5 by the solid black line starting to follow the curved dotted line downwards as the frequency increases beyond the bend in the dotted line.

If a secondary resonator pair is employed, a resonant response will be created by this resonator pair at resonant frequency $F_3$, selected to be greater than $F_2$, the upper frequency limit of the desired passband, by proper choice of length of probe 31 of the secondary resonator. Again, if frequency $F_3$ is too close to $F_2$, the upward sloping (with respect to increasing frequency) portion of the solid line just to the left of $F_3$ will be within the passband. On the other hand, if $F_3$ is chosen to be too high, the phase response will be flat at greater than the passband frequencies, but as the frequency decreases beneath the bend of the dotted line, the solid line will start to follow the curved dotted line downward. The vertical range of the second resonant response increases with increasing dimension A of each second resonator.

Each resonator can be fine tuned by bending it so that the end of probe portion 31 is slightly spread away from the nearest waveguide wall.

The choice of primary versus secondary resonators is governed by the positioning of the phase response curve within the desired passband in the absence of resonators. It is common for this curve to be skewed to the right (toward the higher frequencies), because significantly higher machining deviations are required to pull the curve toward the lower frequencies than to the higher frequencies. Thus, in the common case, primary resonator(s) should be employed because the downward sloping (with increasing frequency) portion of the solid curve just to the right of $F_0$ is well-suited to counteract the extra amount of upward sloping of the dotted curve at the low end of the passband. Secondary resonators can then be used if additional flattening at the high end of the passband is required.

For the less common case where the phase response sans resonators is skewed to the left, just secondary resonators and not primary resonator(s) are needed, because the upward sloping (with respect to increasing frequency) portion of the solid curve just to the left of $F_3$ counteracts the extra amount of downward sloping of the dotted curve at the high end of the passband. Primary resonator(s) can then be used if additional flattening at the low end of the passband is required.

Additional resonators should be used sparingly, because, as with anything added to the system, they add to the VSWR. Also, it should be cautioned that use of the trapped mode resonators creates some spurious resonant responses at lower amplitude than the desired resonant response; this becomes more of a problem at the higher frequencies, because the spurious responses bunch closer in frequency to the desired response as the frequency increases.

Figure 6:
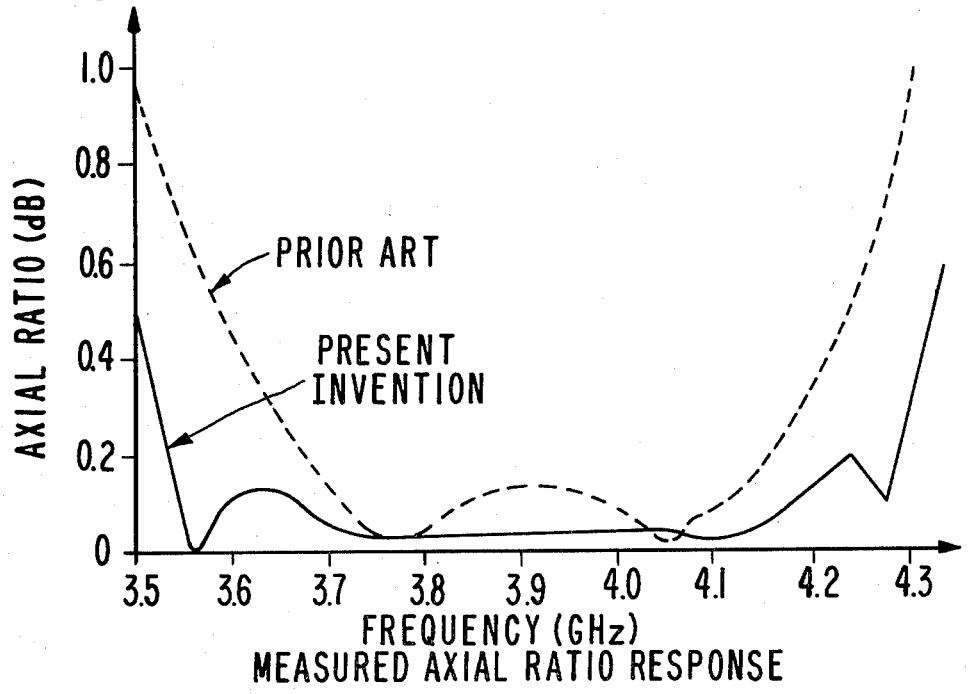
FIG. 6 is a graph showing the axial ratio of a septum polarizer utilizing the present invention as compared with that of the prior art.

FIG. 6 illustrates by means of a dotted line the axial ratio in dB of the balanced septum polarizer of U.S. Pat. No. 4,126,835 as a function of frequency in the domain 3.5 GHz to 4.3 GHz, and by means of a solid line the axial ratio when four trapped mode resonators are inserted in the nonseptum portion of the waveguide according to the teachings of the present invention: primary resonator pair 26, 28, and secondary resonator pair 24, 30. FIG. 6 shows the superior results obtained with the resonators.

The above description is included to illustrate the operation of the preferred embodiments, and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A septum polarizer for converting linearly polarized microwave energy to circularly polarized microwave energy, comprising:

an elongated hollow conductive waveguide having four elongated walls;

an elongated planar conductive septum positioned within said waveguide between a first wall and a second wall that is opposite said first wall; and a first trapped mode resonator positioned within said waveguide, within the plane formed by the septum, and comprising a thin elongated electrically conductive structure protruding from the first wall of the waveguide for producing a resonant response in the phase response of the polarizer at a resonant frequency.

2. The polarizer of claim 1 wherein said walls are flat and have the same dimensions, so that the cross-section of the waveguide is a square.

3. The polarizer of claim 1 wherein said walls are circularly arcuate and have the same dimensions, so that the cross-section of the waveguide is a circle.

4. The polarizer of claim 1 wherein said first resonator is positioned within said waveguide in a region where a cross-section of the waveguide does not cut through said septum; further comprising:

a second trapped mode resonator, substantially identical to the first resonator, positioned within said waveguide within the plane formed by the septum, and protruding from the second wall of the waveguide.

5. The polarizer of claim 1 further comprising:

a third trapped mode resonator positioned within said waveguide, orthogonal to the plane formed by the septum, and protruding from a third wall of the waveguide, wherein said third wall connects said first and second walls; and a fourth trapped mode resonator positioned within said waveguide, orthogonal to the plane formed by the septum, and protruding from a fourth wall of the waveguide, wherein said fourth wall connects said first and second walls and is opposite to said third wall.

6. The polarizer of claim 1 wherein said resonator comprises:

a thin elongated electrically conductive positioning portion protruding from said first wall and orthogonal thereto; and a thin elongated electrically conductive probe connected at one end to said positioning portion and substantially orthogonal thereto, and having a nonconnected end;

wherein the positioning portion and the probe both lie in the plane formed by the septum.

7. The apparatus of claim 6 wherein said resonator produces a resonant response in the phase response of the polarizer at a resonant frequency;

said resonant frequency is made to occur below the lower frequency of the polarizer's passband by means of adjusting the length of the probe; and the degree of intervention in the phase response of the polarizer caused by the resonator is regulated by adjusting the distance between the probe and said first wall.

8. A septum polarizer for converting linearly polarized microwave energy to circularly polarized microwave energy, comprising:

an elongated hollow conductive waveguide having four elongated walls;

an elongated planar conductive septum positioned within said waveguide between a first wall and a second wall opposite said first wall;

a first trapped mode resonator protruding into the interior of said waveguide within a plane orthogonal to that formed by the septum, said first resonator attached to a third wall connecting said first and second walls; and a second trapped mode resonator protruding into the interior of said waveguide within the same plane as said first trapped mode resonator, said second resonator attached to a fourth wall connecting said first and second walls, said fourth wall being opposite to said third wall;

wherein each resonator comprises a thin elongated electrically conductive structure;

wherein the resonators produce a resonant response in the phase response of the polarizer at a resonant frequency.

* * * * *